US005252107A

United States Patent [19]

Wilkins, Jr.

[11] Patent Number: 5,252,107

[45] Date of Patent: Oct. 12, 1993

[54] IGNITION FLUID

[76] Inventor: Joe S. Wilkins, Jr., 1612 Southmore, Pasadena, Tex. 77502

[21] Appl. No.: 749,307

[22] Filed: Aug. 23, 1991

Related U.S. Application Data

[63] Continuation-in-part of Ser. No. 698,486, May 8, 1991, abandoned.

[51] Int. Cl.[5] ..... C10L 5/00; C10L 9/02; C10L 11/00

[52] U.S. Cl. ..... 44/603; 44/307; 44/641; 44/533; 44/302

[58] Field of Search ..... 44/302, 307, 603, 641, 44/533; 252/170

[56] References Cited

U.S. PATENT DOCUMENTS

| | | | |
|---|---|---|---|
| 31 | 9/1836 | Jennings . | |
| 1,469,148 | 9/1923 | Chevalier | 44/307 |
| 2,963,352 | 12/1960 | Davis | 44/603 |
| 3,650,711 | 3/1972 | Unick | 44/545 |
| 3,709,700 | 1/1973 | Ross | 44/603 |
| 3,876,762 | 4/1975 | Rabussier et al. . | |
| 4,336,024 | 6/1982 | Denissenko et al. . | |
| 4,362,638 | 12/1982 | Caskey et al. | 252/170 |
| 4,511,488 | 4/1985 | Matta | 252/162 |
| 4,818,250 | 4/1989 | Whitworth . | |
| 4,847,182 | 7/1989 | Worns | 430/309 |
| 5,061,606 | 10/1991 | Telser et al. . | |

FOREIGN PATENT DOCUMENTS 60-106887 6/1985 Japan .

OTHER PUBLICATIONS

Three "D-Limonene Product Data Sheets," Florida Chemical Co., Inc., Dec. 1, 1989.

"Limonene In Cleaners," The Stepan Company, Apr. 16, 1987.

"All Purpose D-Limonene Cleaner," Chemax, Inc., Jul. 1987.

"Mazon 245-103," Mazer Chemicals, No Date.

"Mico-Emulsion with D-Limonene," Mona No Date.

"Formulations Based on D-Limonene," Exxon Chemical No Date.

"The Safety, Toxicology, and Biodegradation of d-Limonene," Florida Chemical Co., Inc. Sep. 20, 1990.

"Material Safety Data Sheet," Florida Chemical Co., Inc., Jun. 1, 1989.

"d-Limonene Spray Cleaner," DeSoto, Inc., Mar. 1988.

"d-Limonene All-Purpose Cleaner," Stella Mary Hass and Rohm and Haas Companies No Date.

*Primary Examiner*—Prince Willis, Jr.

*Assistant Examiner*—Alan D. Diamond

[57] ABSTRACT

Disclosed are novel, environmentally safe fluids for the ignition of charcoals, the fluids consisting of either liquid terpenes or mixtures of terpenes and aliphatic alcohols, water, and surfactants, as well as methods of using the novel environmentally safe fluids.

27 Claims, No Drawings

IGNITION FLUID

This is a continuation-in-part of application Ser. No. 698,486, filed May 8, 1991 abandoned.

BACKGROUND OF THE INVENTION

1. Field of the Invention

This invention relates to novel, environmentally safe fluids for the ignition of carbonaceous solid fuels and to methods of using the same. More particularly, the present invention relates to the use of terpenes as environmentally safe fluids for the ignition of charcoal, with reduced volatile organic compound emissions upon ignition of the charcoal with said fluids and to methods of using said fluids.

2. Description of the Prior Art

An area of increasing concern centers on the emission of volatile organic compounds which act as pollutants in the atmosphere. A common source of these pollutants results from ignition of barbecue charcoal by conventional lighter fluids. To be useful as a barbecue charcoal lighter fluid, a fluid composition must first have an adequate flash point so that it may be easily ignited without being dangerously explosive, and secondly, once ignited the fluid must generate sufficient heat to ignite the charcoal itself.

Barbecue charcoal ignition fluids heretofore used have typically been comprised of petrochemical distillates. When tested under controlled conditions as described in the Rule 1174 Ignition Method Compliance Certification Protocol of Feb. 28, 1991 of the South Coast Air Quality Management District, charcoal ignition fluids comprised of petrochemical distillates exhibit emissions of volatile organic compounds per start well in excess of the maximum permissible level of 0.02 pound per start. The South Coast Air Quality Management District which is located in Southern California, have, effective January 1, 1992, prohibited the sale within the District of charcoal ignition fluids which exceed an emission limit of 0.02 pounds of volatile organic compounds per start resulting from charcoal ignition.

It would, therefore, be of extreme value to have a charcoal lighter fluid with reduced volatile organic compounds emissions upon ignition.

SUMMARY OF THE INVENTION

The present invention relates to certain environmentally safer fluids for the ignition of carbonaceous solid fuels and to methods of using the same. The fluids of the present invention have a greatly reduced volatile organic compound emissions compared to conventional petroleum distillates used as lighter fluids.

More particularly, the present invention relates to the use of certain terpenes in the formulation of environmentally safer fluids for the lighting of carbonaceous solid fuels and to methods of using the same. These methods include dousing such carbonaceous solid fuels at the time the solid fuel is to be ignited or pre-soaking the solid fuel such that no fluid is needed to be added at the time the solid fuel is to be ignited.

DESCRIPTION OF THE PREFERRED EMBODIMENTS

The present invention relates certain environmentally safer fluids for the igniting of carbonaceous solid fuels and to methods of using said fluids. Carbonaceous solid fuels include, for example, charcoal, wood, paper and the like. The ignition fluid of this invention comprises, at least in part, a normally liquid terpene.

Terpenes are widely distributed in nature, and occur in nearly all living plants. It is generally recognized that the term terpene not only applies to isoprene oligomers, but also to their saturated or partially saturated isomers, as well as to their derivatives, which are referred to as terpenoids, such as, for example, alcohols, aldehydes, esters, etc. Terpenes have been widely used as flavor and perfume materials. Common monoterpenes include turpentine and limonene. Limonene is a naturally occurring chemical found in high concentrations in citrus fruits and spices. In addition to uses as flavor additives and perfume materials, Limonene has been used in household and industrial cleaning products and is commonly available from commercial sources such as Florida Chemical Company, Inc.

Fluids for the igniting of carbonaceous solid fuels must meet two requirements. First, they must possess an adequate flash point such that ignition is readily obtained, but without the risk of detonation or explosive ignition. Second, the fluids in question must, once ignited, generate adequate heat in order to ignite the carbonaceous solid fuel. Additionally, a highly desirable property of these fluids is that they have reduced volatile organic compound emissions. These volatile organic compound emissions are preferably lower than the minimum levels obtainable with petrochemical distillates which emit about 0.0371 pounds of volatile organic compounds per start resulting from barbecue charcoal ignition. Most preferably, emissions will be 0.02 pounds of volatile organic compounds per start or lower.

The fluids of the present invention contain either a terpene alone, a mixture of a terpene and an alcohol, or a mixture of a terpene, an alcohol, water, and a surfactant. While any terpene such as, for example, turpentine, pinene, etc. may be used in the practice of the invention, the most preferred terpenes are those which are abundant, inexpensive and readily obtainable from natural sources. An example of a naturally occurring terpene which may preferentially be used in the practice of the present invention is limonene.

Limonene is found in high concentrations in, among other things, citrus fruits. Limonene has a flash point in the range of about 113° F. to about 124° F., depending upon the purity of the material, which is suitable for use as a carbonaceous solid fuel lighter fluid. Heat generation by ignition of limonene compares favorably with heat generation from presently used carbonaceous solid fuel lighter fluids derived from petrochemical distillates.

Limonene, which is the terpene of preference for preparing carbonaceous solid fuel ignition fluids of this invention, may be commercially obtained from Florida Chemical Company, Inc. in three different grades, named untreated/technical grade, food grade, and lemon-lime grade. The food grade comprises about 97% d-limonene, the untreated/technical grade about 95%, and the lemon-lime grade about 70%, the balance in all being other terpene hydrocarbons and oxygenated compounds. The technical and food grades of limonene are the most preferred for use in this invention.

Limonene generates reduced levels of volatile organic compound emissions when ignited compared to petrochemical distillates.

In order to further reduce volatile organic compound emissions, the fluids of the present invention may be composed of a mixture of a terpene, a normally liquid alcohol, water, and a surfactant. Suitable alcohols are any of the straight or branched chain aliphatic or cyclo-aliphatic alcohols having from 3 to about 10 carbon atoms. Illustrative of suitable alcohols are n-propyl alcohol, n-butyl alcohol, n-pentyl alcohol, n-hexyl alcohol, n-hepty alcohol, n-octyl alcohol, isopropyl alcohol, isobutyl alcohol, sec-butyl alcohol, isopentyl alcohol, tert-pentyl alcohol, allye alcohol, and the like. When a technical grade of d-limonene was tested in accordance with the Feb. 28, 1991 Rule 1174 Ignition Method Compliance Certification Protocol of the South Coast Air Quality Management District of California, it was found to exhibit a volatile organic compounds (VOC) emission of 0.024 pounds per start. Furthermore, incorporation of even a minor amount of an aliphatic or cyclo-aliphatic $C_{3-10}$ alcohol into the limonene reduces the VOC emissions of the blended fluid to levels below that of 0.02 pounds per start.

The addition of water and a surfactant has been found to further increase the flash point of the fluid mixture while further reducing VOC emissions. The types of surfactants that can be used in the present invention are commonly known to those skilled in the art and are typically those having HLB (i.e. hydrophilic-lipophilic balance) values ranging from 8–15. Examples of such surfactants that can be used in the present invention include alkylphenol ethoxylates such as Triton® X-100, Triton® X-114, and Makon 10®. A preferred surfactant used in the present invention is Triton® X-114 (i.e. octylphenoxy polyethoxy-ethanol) in which volumes ranging from about 1.0 ml to about 16.0 ml (i.e. about 0.1 percent to 2.5 weight percent) are added to a 32-fluid ounce mixture. Other surfactants, such as Mazclean EP®, can also be employed; however, larger volumes of up to 60 to 70 ml must be added to solubilize a 32-fluid ounce mixture (i.e. no separation between the aqueous and organic layers.

Accordingly, a preferred carbonaceous solid fuel ignition fluid of this invention comprises from about 15 to about 30 weight percent of a normally liquid terpene in admixture with at least 40 weight percent to about 70 weight percent of a normally liquid aliphatic or cyclo-aliphatic alcohol containing from about 3 to about 6 carbon atoms, from at least 10 weight percent to about 30 weight percent water, and a surfactant. More preferably, the mixture will consist of limonene, a $C_{3-5}$ alcohol, water, and a surfactant, wherein the mixture may range from about 10 to about 25 weight percent water, from about 15 to about 25 weight percent limonene, and from about 50 to about 70 weight percent $C_{3-4}$ alcohol. The most preferred compositions for the fluid mixture include: a) about 62 weight percent butanol, about 24 weight percent d-limonene, about 13 weight percent water, and about 1.0 wt percent surfactant; b) about 17 weight percent water, about 59 weight percent butanol, about 21 weight percent d-limonene, and about 2 weight percent; and c) about 23 weight percent water, about 56 weight percent butanol, and about 19 weight percent d-limonene and about 1.5 weight percent surfactant. The amount of surfactant used will in each of the foregoing compositions depend primarily upon the surfactant used in the formulation. For example, if Triton® X-114 (octylphenoxypolyethoxyethanol) is used, as little as 1.0 to 1.5 ml may be added to 946 ml (i.e. 32 ounces) of fluid mixture. However, as much as 60 to 70 ml of Mazclear EP®, or approximately 2 parts of surfactant to every 3 parts d-limonene, must be added to the same amount of fluid mixture.

While alcohols alone have significantly reduced volatile organic compound emissions, and have suitable flash points, they lack suitable heat generating capacity and, therefore, are ineffective as charcoal lighter fluids themselves.

The invention fluid mixture may be prepared by first combining d-limonene and the surfactant and then agitating the two components until the mixture becomes bonded (i.e. forms a clear, single phase solution). Next, the alcohol is added to the d-limonene/surfactant solution. The temperature of the resulting solution first decreases and then increases again. Water is then slowly added to the d-limonene/surfactant/alcohol solution, and the entire fluid mixture is blended until the mixture, which has a hazy appearance, becomes warm again. Upon standing for 10–12 hours, the mixture becomes clear and is a single phase, homogenous fluid mixture. About 0.5 ml of residue, which remains at the bottom of the solution, is filtered out.

Another method for preparing the invention fluid mixture involves first blending the d-limonene and surfactant. Water is then added, and the mixture is blended until the mixture becomes warm. Next, the butyl alcohol is added to the d-limonene/surfactant/water mixture until the mixture becomes warm again. Upon standing for about three to five hours, the mixture becomes clear and is a single phase, homogenous fluid mixture having no residue remaining.

The fluids for the lighting of carbonaceous solid fuel of the present invention may be used in any of the conventional methods used for the lighting of such fuels. These methods include the dousing method wherein a suitable amount of fluid is placed upon the solid fuel to be ignited and then the fluid is ignited by introduction of an open flame, usually from a lighted match. As an example, 2 lbs. of charcoal may be readily ignited with as little as about 2–4 ounces of the fluids of the present invention.

Another method which may be used in the practice of the invention relates to the pre-soaking of the carbonaceous solid fuel with the fluid. The pre-soaked solid fuel is then stored in a sealed container such as, for example, a lined bag wherein the lining is impermeable to any volatile emissions from the fluid, although other methods of storage are available. The pre-soaked solid fuel may then, at any suitable time within the shelf life of the material, be used. The pre-soaked solid fuel may be placed in any suitable container such as, for example, a grill or a pit and then ignited by introduction of an open flame, usually from a lighted match.

The following examples are intended to illustrate the invention as described above and claimed hereafter and are not intended to limit the scope of the invention in any way.

EXAMPLE 1

A 32-fluid ounce d-limonene fluid mixture was prepared by combining 7.7 fluid ounces of d-limonene and approximately 1.0 ml of Triton® X-114 in a blender. The mixture was then agitated until bonded. Next, about 20.8 fluid ounces of butyl alcohol was added to the d-limonene/surfactant mixture and blended, after-which the temperature of the resulting mixture decreased and then increased again. Once the mixture bonded, about 3.5 fluid ounces of water was slowly added to the mixture. The mixture was blended until warm and then allowed to stand. After approximately 10 to 12 hours, the mixture was completely solubilized; i.e. the mixture had changed from a hazy mixture having separate layers to a clear, single phase mixture with only about 0.5 residue remaining on the bottom. This residue was filtered away from the final product. The resulting fluid mixture exhibited VOC emissions of 0.016 pounds per start resulting from charcoal ignition, which was in compliance with the South Coast Air Quality Management District standard.

EXAMPLE 2

A 32-fluid ounce d-limonene ignition fluid mixture was prepared as described in Example 1 using instead the following volumes of compounds: 7.0 fluid ounces of d-limonene; 1.0 ml of Triton® X-114; 20.2 fluid ounces of butyl alcohol; and 4.8 fluid ounces of water.

EXAMPLE 3

A 32-fluid ounce d-limonene ignition fluid mixture was prepared as described in Example 1 using instead the following volumes of compounds: 7.7 fluid ounces of d-limonene, about 1.0 ml of Triton® X-114, 19.5 fluid ounces of butyl alcohol, and 4.8 fluid ounces of water.

EXAMPLE 4

A 32-fluid ounce d-limonene ignition fluid mixture was prepared as described in Example using the following volumes of compounds: 6.4 fluid ounces d-limonene, about 1.0 ml drops of Triton® X-114, 19.2 fluid ounces of butyl alcohol, and 6.4 fluid ounces water.

EXAMPLE 5

An 8-fluid ounce d-limonene ignition fluid mixture was prepared by first blending 1.9 fluid ounces of d-limonene and 1.8 ml of Triton® X-114. Next, 0.88 fluid ounces of water was added to the d-limonene/surfactant mixture and blended. After the mixture became warm, 5.2 fluid ounces of butyl alcohol was slowly added, and the entire fluid mixture was blended until the mixture started to clear. The mixture was allowed to stand, and after about 3 to 5 hours, the mixture became clear and contained no residue.

EXAMPLE 6

An 8-fluid ounce d-limonene ignition fluid mixture was prepared as described in Example 5 using 1.6 fluid ounces, d-limonene 2.9 ml of Triton® X-114, 1.6 fluid ounces of water, and 4.8 fluid ounces of butyl alcohol. The final mixture became clear upon standing after about 3 to 5 hours.

EXAMPLE 7

An 8-fluid ounce d-limonene ignition fluid mixture was prepared as described in Example 5 using 1.6 fluid ounces of d-limonene, 2.4 ml of Triton® X-114, 1.2 fluid ounces of water, and 5.2 fluid ounces of butyl alcohol. The final mixture became clear upon standing after about 3 to 5 hours.

EXAMPLE 8

An 8-fluid ounce d-limonene ignition fluid mixture was prepared by using 1.8 fluid ounces of d-limonene, 4.1 ml of Triton® X-114, 1.2 fluid ounces of water, and 5.0 fluid ounces of butyl alcohol. The final mixture became clear upon standing after about 3 to 5 hours.

I claim:

1. A composition for the ignition of carbonaceous solid fuel which emits less than 0.02 pounds per start of volatile organic compounds expressed as $CH_2$, comprising from about 10 to about 25 weight percent water, from about 15 to about 25 weight percent of a normally liquid terpene, from about 50 to about 70 weight percent of a normally liquid alcohol having from about 3 to about 10 carbon atoms, and about from about 0.1 to about 2.5 weight percent of a surfactant.

2. The composition of claim 1 wherein said terpene is d-limonene, said alcohol is butyl alcohol, and said surfactant is octylphenoxypolyethoxyethanol.

3. The composition of claim 2 wherein said composition comprises about 21 weight percent of d-limonene, about 59 weight percent of butyl alcohol, about 17 weight percent water, and about 2.2 weight percent octylphenoxypolyethoxyethanol.

4. A method for igniting carbonaceous solid fuel comprising the steps of applying a fluid comprising a normally liquid terpene, a normally liquid alcohol having from about 3 to about 10 carbon atoms, water, and a sufficient amount of surfactant to solubilize said terpene, alcohol, and water; and igniting the applied fluid.

5. The method of claim 4 wherein said terpene is limonene.

6. The method of claim 5 wherein said limonene comprises from about 15 to about 30 weight percent of said fluid.

7. The method of claim 6 wherein said alcohol is a $C_{3-6}$ alcohol.

8. The method of claim 7 wherein said $C_{3-6}$ alcohol comprises about 40 to about 70 weight percent of said fluid.

9. The method of claim 8 wherein said water comprises from about 10 to about 30 weight percent of said fluid.

10. The method of claim 9 wherein said fluid comprises from about 40 to about 70 weight percent butyl alcohol, from about 10 to about 30 weight percent water, from about 15 to about 30 weight percent limonene, and a sufficient amount of said surfactant to solubilize said limonene, water and alcohol.

11. The method of claim 5 wherein said fluid comprises from about 15 to about 25 weight percent limonene, from about 10 to about 25 weight percent water, from about 50 to about 70 weight percent $C_{3-6}$ alcohol, and a sufficient amount of said surfactant to solubilize said limonene, water and alcohol.

12. The method of claim 4 wherein said fluid comprises about 21 weight percent of d-limonene, about 59 weight percent of butyl alcohol, about 17 weight percent water, and about 2.2 weight percent octylphenoxypolyethoxyethanol.

13. An article of manufacture comprising a carbonaceous solid fuel having a fluid applied thereto, said fluid comprising a normally liquid terpene, a normally liquid alcohol having from about 3 to about 10 carbon atoms, water, and a sufficient amount of surfactant to solubilize said terpene, alcohol, and water.

14. The article of manufacture of claim 13 wherein the terpene is limonene.

15. The article of manufacture of claim 14 wherein said limonene comprises from about 15 to about 30 weight percent of said fluid.

16. The article of manufacture of claim 15 wherein said alcohol is $C_{3-6}$ alcohol.

17. The article of manufacture of claim 16 wherein said $C_{3-6}$ alcohol comprises about 40 to about 70 weight percent of said fluid.

18. The article of manufacture of claim 17 wherein said water comprises from about 10 to about 30 weight percent of said fluid.

19. The article of manufacture of claim 18 wherein said fluid comprises from about 40 to about 70 weight percent butyl alcohol, from about 10 to about 30 weight percent limonene, and a sufficient amount of said surfactant to solubilize said limonene, water, and alcohol.

20. The article of manufacture of claim 14 wherein said fluid comprises from about 15 to about 25 weight percent limonene, from about 10 to about 25 weight percent water, from about 50 to about 70 weight percent $C_{3-6}$ alcohol, and a sufficient amount of surfactant to solubilize said limonene, water and alcohol.

21. A method for igniting carbonaceous solid fuel comprising the steps of applying a fluid comprising limonene to said carbonaceous solid fuel, and igniting the applied fuel to ignite said carbonaceous solid fuel with an emission less than 0.0371 pounds per start of volatile organic compounds expressed in $CH_2$.

22. The method of claim 21 wherein said fluid further comprises a normally liquid alcohol having from about 3 to about 10 carbon atoms.

23. The method of claim 22 wherein said alcohol comprises a $C_{3-6}$ alcohol.

24. An article of manufacture comprising a carbonaceous solid fuel having a fluid applied thereto comprising limonene and a normally liquid alcohol having from 3 to about 10 carbon atoms, wherein said carbonaceous solid fuel emits less than 0.02 pounds per start of volatile organic compounds expressed as $CH_2$.

25. A method of lighting carbonaceous solid fuel comprising the steps of:

presoaking a carbonaceous solid fuel with a carbonaceous solid fuel lighter fluid comprising limonene fluid; and igniting said pre-soaked carbonaceous solid fuel, wherein said carbonaceous solid fuel emits less than 0.0371 pounds per start of volatile organic compounds expressed as $CH_2$.

26. The method of claim 25 wherein the carbonaceous solid fuel lighter fluid further comprises an alcohol.

27. An article of manufacture comprising a carbonaceous solid fuel having a fluid applied thereto comprising limonene, wherein said carbonaceous solid fuel emits less than 0.0371 pounds per start of volatile organic compounds expressed as $CH_2$.

* * * * *